US008651939B2

(12) United States Patent
Nordman

(10) Patent No.: US 8,651,939 B2
(45) Date of Patent: Feb. 18, 2014

(54) GAMING SYSTEM HAVING A PLURALITY OF ADJACENTLY ARRANGED GAMING MACHINES AND A MECHANICAL MOVEABLE INDICATOR OPERABLE TO INDIVIDUALLY INDICATE THE GAMING MACHINES

(75) Inventor: Dennis Nordman, Lake Villa, IL (US)

(73) Assignee: IGT, Las Vegas, NV (US)

( * ) Notice: Subject to any disclaimer, the term of this patent is extended or adjusted under 35 U.S.C. 154(b) by 861 days.

(21) Appl. No.: 11/235,018

(22) Filed: Sep. 26, 2005

(65) Prior Publication Data

US 2006/0073868 A1 Apr. 6, 2006

Related U.S. Application Data

(60) Provisional application No. 60/614,998, filed on Oct. 1, 2004.

(51) Int. Cl.
*A63F 9/24* (2006.01)

(52) U.S. Cl.
USPC ..... 463/20; 463/1; 463/16; 463/30; 463/31; 463/32; 463/33; 463/34; 463/35; 463/40; 463/42; 463/47; 273/138.1; 273/142; 273/141 R; 273/141 A

(58) Field of Classification Search
USPC ..... 463/1, 16–20, 30–35, 40, 42, 47; 273/138.1, 142, 141 R, 141 A
See application file for complete search history.

(56) References Cited

U.S. PATENT DOCUMENTS

| | | | |
|---|---|---|---|
| 3,533,629 | A | 10/1970 | Raven |
| 3,645,531 | A | 2/1972 | Wright |
| 4,335,809 | A | 6/1982 | Wain |
| 4,522,399 | A | 6/1985 | Nishikawa |
| 4,614,342 | A | 9/1986 | Takashima |
| 4,652,998 | A | 3/1987 | Koza et al. |
| 4,678,191 | A | 7/1987 | Mills et al. |
| 4,805,907 | A | 2/1989 | Hagiwara |
| 4,837,728 | A | 6/1989 | Barrie et al. |

(Continued)

FOREIGN PATENT DOCUMENTS

| | | |
|---|---|---|
| AU | 1999 43487 | 3/2000 |
| EP | 0 981 119 A2 | 2/2000 |

(Continued)

OTHER PUBLICATIONS

2nd Chance 7s article, published by Strictly Slots in Nov. 2000.

(Continued)

*Primary Examiner* — Dmitry Suhol
*Assistant Examiner* — Andrew Kim
(74) *Attorney, Agent, or Firm* — Neal, Gerber & Eisenberg LLP

(57) ABSTRACT

A gaming system comprised of a plurality of adjacently arranged gaming machines and a mechanical moveable gaming machine indicator operable to individually indicate the gaming machines. The gaming machine indicator is mounted or positioned near the adjacently arranged gaming machines. A controller actuates the mechanical moveable gaming machine indicator to rotate or move. The mechanical moveable gaming machine indicator may also include lighting effects. The controller is operable to select a gaming machine and actuate the mechanical moveable gaming machine indicator to indicate the selected gaming machine.

30 Claims, 11 Drawing Sheets

(56) References Cited

U.S. PATENT DOCUMENTS 4,976,438 A 12/1990 Tashiro et al.
5,046,736 A 9/1991 Bridgeman et al.
5,083,800 A 1/1992 Lockton
5,116,055 A 5/1992 Tracy
5,120,060 A 6/1992 Parker et al.
5,133,017 A 7/1992 Cain et al.
5,167,413 A 12/1992 Fulton
5,188,363 A 2/1993 Marnell, II et al.
5,217,224 A * 6/1993 Sincock ..... 463/17
5,221,083 A 6/1993 Dote
5,242,163 A 9/1993 Fulton
5,259,613 A 11/1993 Marnell, II
5,280,909 A 1/1994 Tracy
D344,296 S 2/1994 McKay et al.
5,292,127 A 3/1994 Kelly et al.
5,318,298 A 6/1994 Kelly et al.
5,370,399 A 12/1994 Liverance
5,411,270 A 5/1995 Naka et al.
5,431,492 A 7/1995 Rothschild et al.
5,444,786 A 8/1995 Raviv
5,469,510 A 11/1995 Blind et al.
5,524,888 A 6/1996 Heidel
5,533,727 A 7/1996 DeMar
5,542,669 A 8/1996 Charron et al.
5,560,603 A 10/1996 Seelig et al.
5,564,700 A 10/1996 Celona
5,580,309 A 12/1996 Piechowiak et al.
5,605,506 A 2/1997 Hoorn et al.
5,611,730 A 3/1997 Weiss
5,622,366 A 4/1997 Inoue
5,634,639 A 6/1997 Tokito et al.
5,639,089 A 6/1997 Matsumoto et al.
5,655,961 A 8/1997 Acres et al.
D383,171 S 9/1997 Hanscom
5,664,998 A 9/1997 Seelig et al.
5,674,127 A 10/1997 Horstmann et al.
5,695,188 A 12/1997 Ishibashi
5,695,400 A 12/1997 Fennell, Jr. et al.
5,702,304 A 12/1997 Acres et al.
5,741,183 A 4/1998 Acres et al.
5,743,798 A 4/1998 Adams et al.
5,752,882 A 5/1998 Acres et al.
5,755,619 A 5/1998 Matsumoto et al.
5,762,552 A 6/1998 Vuong et al.
5,766,076 A 6/1998 Pease et al.
5,772,509 A 6/1998 Weiss
5,775,993 A 7/1998 Fentz et al.
5,779,544 A 7/1998 Seelig et al.
5,788,573 A 8/1998 Baerlocher et al.
5,807,177 A 9/1998 Takemoto et al.
5,816,918 A 10/1998 Kelly et al.
5,816,920 A 10/1998 Hanai
5,820,459 A 10/1998 Acres et al.
5,823,874 A 10/1998 Adams
5,823,879 A 10/1998 Goldberg et al.
5,828,768 A 10/1998 Eatwell et al.
5,830,063 A 11/1998 Byrne
5,833,538 A 11/1998 Weiss
5,836,817 A 11/1998 Acres et al.
5,848,932 A * 12/1998 Adams ..... 463/20
5,851,148 A 12/1998 Brune et al.
5,876,284 A 3/1999 Acres et al.
5,879,235 A 3/1999 Kaneko et al.
5,882,261 A 3/1999 Adams
5,885,158 A 3/1999 Torango et al.
5,911,418 A 6/1999 Adams
5,924,927 A 7/1999 Matsuura et al.
5,941,773 A 8/1999 Harlick
5,947,820 A 9/1999 Morro et al.
5,951,015 A 9/1999 Smith et al.
5,967,820 A 10/1999 Siegal et al.
5,971,850 A 10/1999 Liverance
5,976,015 A 11/1999 Seelig et al.
5,976,019 A 11/1999 Ikeda et al.
5,984,782 A 11/1999 Inoue
5,997,400 A 12/1999 Seelig et al.
6,012,982 A 1/2000 Piechowiak et al.
D421,068 S 2/2000 Yamaguchi
6,019,369 A 2/2000 Nakagawa et al.
6,023,729 A 2/2000 Samuel et al.
6,027,115 A 2/2000 Griswold et al.
6,033,307 A 3/2000 Vancura
6,039,649 A 3/2000 Schulze
6,043,615 A 3/2000 Forbes
6,059,289 A 5/2000 Vancura
6,059,658 A 5/2000 Mangano et al.
6,068,552 A 5/2000 Walker et al.
6,068,553 A 5/2000 Parker
6,077,162 A 6/2000 Weiss
6,082,734 A 7/2000 Uehara et al.
6,089,663 A 7/2000 Hill
6,089,978 A 7/2000 Adams
6,089,980 A 7/2000 Gauselmann
6,105,962 A 8/2000 Malavazos et al.
6,110,041 A * 8/2000 Walker et al. ..... 463/20
6,110,043 A 8/2000 Olsen
6,117,009 A 9/2000 Yoseloff
6,142,872 A 11/2000 Walker et al.
6,142,873 A 11/2000 Weiss et al.
6,146,273 A 11/2000 Olsen
6,152,823 A 11/2000 Lacoste et al.
6,159,098 A 12/2000 Slomiany et al.
6,162,121 A 12/2000 Morro et al.
6,162,122 A 12/2000 Acres et al.
6,168,520 B1 1/2001 Baerlocher et al.
6,183,366 B1 2/2001 Goldberg et al.
D439,282 S 3/2001 Yamaguchi
6,201,532 B1 3/2001 Tode et al.
6,210,275 B1 4/2001 Olsen
6,210,277 B1 4/2001 Stefan
6,217,448 B1 * 4/2001 Olsen ..... 463/25
6,224,482 B1 5/2001 Bennett
6,224,483 B1 5/2001 Mayeroff
6,241,608 B1 6/2001 Torango
6,254,483 B1 7/2001 Acres
6,257,981 B1 7/2001 Acres et al.
6,264,560 B1 7/2001 Goldberg et al.
6,280,325 B1 8/2001 Fisk
6,302,790 B1 10/2001 Brossard
6,308,953 B1 10/2001 Nagano
6,309,299 B1 10/2001 Weiss
D451,153 S 11/2001 Hedrick et al.
6,315,666 B1 11/2001 Mastera et al.
6,319,122 B1 11/2001 Packes, Jr. et al.
6,319,125 B1 11/2001 Acres
D451,558 S 12/2001 Sano
6,334,814 B1 1/2002 Adams
6,336,863 B1 1/2002 Baerlocher et al.
6,358,149 B1 3/2002 Schneider et al.
6,361,441 B1 3/2002 Walker et al.
6,364,314 B1 4/2002 Canterbury
6,364,767 B1 4/2002 Brossard et al.
6,364,768 B1 4/2002 Acres et al.
6,371,852 B1 4/2002 Acres
6,375,567 B1 4/2002 Acres
6,375,568 B1 4/2002 Roffman et al.
6,375,569 B1 4/2002 Acres
6,386,974 B1 5/2002 Adams
6,409,595 B1 6/2002 Uihlein et al.
6,416,408 B2 7/2002 Tracy et al.
6,416,409 B1 7/2002 Jordan
6,416,411 B1 7/2002 Tsukahara
6,422,941 B1 7/2002 Thorner et al.
6,431,983 B2 8/2002 Acres
6,435,968 B1 8/2002 Torango
D462,397 S 9/2002 Baker et al.
RE37,885 E 10/2002 Acres et al.
6,464,582 B1 10/2002 Baerlocher et al.
6,464,586 B1 10/2002 Kamata et al.
6,471,589 B1 10/2002 Nagano
6,475,090 B2 11/2002 Roelofs
6,491,584 B2 12/2002 Graham et al.
6,506,117 B2 1/2003 DeMar et al.
6,508,709 B1 1/2003 Karmarkar

(56) References Cited

U.S. PATENT DOCUMENTS

| | | | | |
|---|---|---|---|---|
| 6,530,842 | B1 | 3/2003 | Wells et al. | |
| 6,537,152 | B2 * | 3/2003 | Seelig et al. | 463/30 |
| D475,091 | S | 5/2003 | Tsuda | |
| 6,561,908 | B1 | 5/2003 | Hoke | |
| 6,564,108 | B1 | 5/2003 | Makar et al. | |
| 6,565,434 | B1 | 5/2003 | Acres | |
| 6,572,471 | B1 | 6/2003 | Bennett | |
| 6,572,473 | B1 | 6/2003 | Baerlocher | |
| 6,575,832 | B1 | 6/2003 | Manfredi et al. | |
| 6,592,460 | B2 | 7/2003 | Torango | |
| 6,607,195 | B2 | 8/2003 | Vancura | |
| 6,620,046 | B2 | 9/2003 | Rowe | |
| 6,626,758 | B1 | 9/2003 | Parham et al. | |
| 6,629,887 | B1 | 10/2003 | Todaiji et al. | |
| 6,638,169 | B2 | 10/2003 | Wilder et al. | |
| 6,648,753 | B1 | 11/2003 | Tracy et al. | |
| 6,656,040 | B1 | 12/2003 | Brosnan et al. | |
| 6,656,043 | B2 | 12/2003 | Seelig et al. | |
| 6,656,048 | B2 | 12/2003 | Olsen | |
| 6,663,488 | B1 | 12/2003 | Adams | |
| 6,676,513 | B2 | 1/2004 | Gauselmann | |
| 6,676,514 | B1 | 1/2004 | Kusuda et al. | |
| 6,682,073 | B2 | 1/2004 | Bryant et al. | |
| D486,869 | S | 2/2004 | Webb et al. | |
| 6,685,560 | B1 | 2/2004 | Hughes | |
| 6,692,354 | B2 | 2/2004 | Tracy et al. | |
| D487,582 | S | 3/2004 | McGahn et al. | |
| 6,705,944 | B2 | 3/2004 | Luciano | |
| 6,712,693 | B1 | 3/2004 | Hettinger | |
| 6,712,694 | B1 | 3/2004 | Nordman | |
| 6,712,695 | B2 | 3/2004 | Mothwurf et al. | |
| 6,712,702 | B2 | 3/2004 | Goldberg et al. | |
| 6,715,756 | B2 | 4/2004 | Inoue | |
| 6,722,976 | B2 | 4/2004 | Adams | |
| 6,887,154 | B1 | 5/2005 | Luciano, Jr. et al. | |
| 6,899,625 | B2 | 5/2005 | Luciano, Jr. et al. | |
| 6,928,413 | B1 | 8/2005 | Pulitzer | |
| 6,935,955 | B1 | 8/2005 | Kaminkow et al. | |
| 2001/0003709 | A1 | 6/2001 | Adams | |
| 2001/0004606 | A1 | 6/2001 | Tracy et al. | |
| 2001/0018361 | A1 | 8/2001 | Acres | |
| 2002/0037763 | A1 | 3/2002 | Idaka | |
| 2002/0039919 | A1 | 4/2002 | Joshi et al. | |
| 2002/0052234 | A1 | 5/2002 | Adams | |
| 2002/0055381 | A1 | 5/2002 | Tarantino | |
| 2002/0090990 | A1 | 7/2002 | Joshi et al. | |
| 2002/0103029 | A1 | 8/2002 | Finlayson et al. | |
| 2002/0142825 | A1 | 10/2002 | Lark et al. | |
| 2002/0142826 | A1 | 10/2002 | Adams | |
| 2002/0142830 | A1 | 10/2002 | Adams | |
| 2002/0142846 | A1 | 10/2002 | Paulsen | |
| 2002/0151342 | A1 | 10/2002 | Tracy et al. | |
| 2002/0151349 | A1 | 10/2002 | Joshi | |
| 2002/0160826 | A1 * | 10/2002 | Gomez et al. | 463/16 |
| 2002/0198038 | A1 | 12/2002 | Adams | |
| 2003/0011127 | A1 | 1/2003 | Vancura et al. | |
| 2003/0013520 | A1 | 1/2003 | Adams | |
| 2003/0040355 | A1 | 2/2003 | Baerlocher | |
| 2003/0045360 | A1 | 3/2003 | Hora | |
| 2003/0054881 | A1 | 3/2003 | Hedrick et al. | |
| 2003/0060277 | A1 | 3/2003 | Webb et al. | |
| 2003/0064793 | A1 * | 4/2003 | Baerlocher et al. | 463/25 |
| 2003/0064796 | A1 | 4/2003 | Glavich et al. | |
| 2003/0087689 | A1 | 5/2003 | Adams | |
| 2003/0100359 | A1 | 5/2003 | Loose et al. | |
| 2003/0100361 | A1 | 5/2003 | Sharpless et al. | |
| 2003/0114214 | A1 | 6/2003 | Barahona et al. | |
| 2003/0114216 | A1 | 6/2003 | Adams | |
| 2003/0157979 | A1 | 8/2003 | Cannon et al. | |
| 2003/0181234 | A1 | 9/2003 | Falciglia, Sr. | |
| 2003/0190957 | A1 | 10/2003 | Tanskanen | |
| 2003/0199316 | A1 | 10/2003 | Miyamoto et al. | |
| 2004/0002372 | A1 | 1/2004 | Rodgers et al. | |
| 2004/0009807 | A1 | 1/2004 | Miller et al. | |
| 2004/0009811 | A1 | 1/2004 | Torango | |
| 2004/0029637 | A1 | 2/2004 | Hein, Jr. et al. | |
| 2004/0033831 | A1 | 2/2004 | Tarantino | |
| 2004/0038728 | A1 | 2/2004 | Adams | |
| 2004/0038734 | A1 | 2/2004 | Adams | |
| 2004/0048645 | A1 | 3/2004 | Webb et al. | |
| 2004/0051240 | A1 | 3/2004 | Adams | |
| 2004/0053660 | A1 | 3/2004 | Webb et al. | |
| 2004/0053665 | A1 | 3/2004 | Baerlocher | |
| 2004/0082377 | A1 * | 4/2004 | Seelig et al. | 463/17 |
| 2004/0082378 | A1 | 4/2004 | Peterson et al. | |
| 2004/0102237 | A1 | 5/2004 | Baerlocher | |
| 2004/0121838 | A1 | 6/2004 | Hughs-Baird et al. | |
| 2004/0142739 | A1 | 7/2004 | Loose et al. | |
| 2004/0147306 | A1 | 7/2004 | Randall et al. | |
| 2004/0162128 | A1 | 8/2004 | Baerlocher et al. | |
| 2004/0204226 | A1 | 10/2004 | Foster et al. | |
| 2005/0059474 | A1 | 3/2005 | O'Halloran | |
| 2005/0079911 | A1 | 4/2005 | Nakatsu | |
| 2005/0101384 | A1 | 5/2005 | Parham | |
| 2005/0137014 | A1 | 6/2005 | Vetelainen | |
| 2005/0153780 | A1 | 7/2005 | Gauselmann | |
| 2006/0009285 | A1 | 1/2006 | Pryzby et al. | |
| 2006/0040732 | A1 | 2/2006 | Baerlocher et al. | |
| 2006/0046821 | A1 | 3/2006 | Kaminkow et al. | |

FOREIGN PATENT DOCUMENTS

| | | |
|---|---|---|
| GB | 2 098 776 | 11/1982 |
| GB | 2 322 217 | 8/1998 |
| GB | 2 201 821 | 9/1998 |
| GB | 2350715 | 12/2000 |
| JP | 09108431 A * | 4/1997 |
| JP | 10-277213 | 10/1998 |
| WO | WO 99 03078 | 1/1999 |
| WO | WO 00 32286 | 6/2000 |
| WO | WO 01 05477 A2 | 1/2001 |
| WO | WO 01 33905 A2 | 5/2001 |
| WO | WO 02 24288 A2 | 3/2002 |
| WO | WO 02 40921 A3 | 5/2002 |

OTHER PUBLICATIONS

77's Above Advertisement published by Bell-Fruit Games prior to Sep. 30, 2004.

Alice in Cardland advertisement, published by Eolith prior to Sep. 30, 2004.

American Bandstand advertisement, published by IGT in 2001.

Astra article published in Coinslot Industry in Jan. 2003.

Atronic Merchandising advertisement, written by Atronic, published in 2004.

Atronic WAPs advertisement, published by Atronic in 2004.

Big Shot Game advertisement, published by Aristocrat in 2002.

Big Top Keno advertisement, published by Aristocrat in Oct. 2000.

Blazing Sevens Wheel of Gold advertisement, published prior to Sep. 30, 2004.

Bonus Road Rally Game advertisement, published by A. C. Coin & Slot Service Company in 1997.

Cash Express Game advertisement, published by Aristocrat in 2001.

Cash Express Game advertisement, published by Aristocrat in 2002.

Cash Express Game advertisement, published by Aristocrat, prior to Sep. 30, 2004.

Cash Express How to Play Guide advertisement, published by Aristocrat prior to Sep. 30, 2004.

Casino Beaver Las Vegas! published by Global Games, prior to Sep. 30, 2004.

Cyclone advertisement, written by Innovative Concepts in Entertainment, published prior to Sep. 30, 2004.

Dance to It! Article, published by Strictly Slots in Jan. 2002.

Dice Shaker advertisement, written by Elaut, published prior to Sep. 30, 2004.

Eeben Gaming Machine advertisement, published in Oct. 2004.

Game Time International Gaming advertisements, published in Aug. 2004.

Games and Technology article and photograph, published by International Gaming and Wagering Business in Jan. 2003.

(56) References Cited

OTHER PUBLICATIONS

Games Station advertisement, written by Atronic International, published Feb. 2003.
Golden Dice advertisement, written by Cadillac Jack, published in 2004.
Golden Roulette advertisement, written by Cadillac Jack, published in 2004.
Hot Potato advertisement, written by Mikohn, published in 1999.
Jackpot Carnival advertisement written by Aristocrat in the Gaming Entertainers Magazine 2003, published in 2003.
Lucky Wheel advertisement written by Carat Gaming Technology, published prior to Sep. 30, 2004.
Monte Carlo advertisement, written by Bally Gaming Systems, published in 2004.
Monte Carlo advertisement, published by Bally Gaming Systems prior to Sep. 30, 2004.
Monte Carlo Game advertisement, published by Bally Gaming Systems in 2003.
Magic Roulette De Luxe advertisement by IAMC, published by IAMC in 2004.
Party Games advertisement, published by Astra in 2003.
Party Time Bingo Advertisement published by Astra Games Limited, prior to Sep. 30, 2004.
Quarter Millions advertisement, written by Bally Gaming, Inc., published in 2003.
Quarter Millions advertisement, written by Bally Gaming, Inc., published in 2004.
Quarter Millions article, published by Strictly Slots in Apr. 2004.
Rapid Roulette Game advertisement, published by John Huxley in 2003.
Rapid Roulette Product Overview Game advertisement, published by John Huxley in 2002.
Ring-a-Bell Game advertisement, published by JPM prior to Sep. 30, 2004.
RNGs and Multi-Coin Plays article, published by Strictly Slots in Aug. 2004.
Roulette Grand Jeu advertisement, published by Amatic Industries prior to Sep. 30, 2002.
Roulette Grand Jeu Game description and advertisement, published by Amatic Industries prior to Sep. 30, 2004.
Roulette Prestige advertisement, written by IAMC, published in 2004.
Shaking Dice advertisement, published by General Automatic Amusement prior to Sep. 30, 2004.
Showtime advertisement, written by Red Gaming, published prior to Sep. 30, 2004.
Slot Machines (In Part) written by Marshal Fey, published 1997.
Super Reel advertisement, published by Electrocoin Gaming prior to Sep. 30, 2004.
Twinkle Dome advertisement, written by Manjyudo Co, published prior to Sep. 30, 2004.
Victory advertisement, written by Elaut, published prior to Sep. 30, 2004.
Victory Game advertisement, published by General Automatic Amusement prior to Sep. 30, 2004.
Weint, Joe, Entertainment Vehicles, IGWB New '97 Games, Mar. 1997, pp. 11-12, 15-18.
Wheel of Fortune classic gaming machine photograph, available prior to Sep. 30, 2004.
Wheel of Fortune Game advertisement, published by General Automatic Amusement prior to Sep. 30, 2004.
ZeroLabs advertisement, written by ZeroLabs, published in 2004.
Zorro advertisement, written by Aristocrat, published in 2004.

* cited by examiner

GAMING SYSTEM HAVING A PLURALITY OF ADJACENTLY ARRANGED GAMING MACHINES AND A MECHANICAL MOVEABLE INDICATOR OPERABLE TO INDIVIDUALLY INDICATE THE GAMING MACHINES

PRIORITY CLAIM

This application is a non-provisional of, claims priority to and claims the benefit of U.S. Provisional Patent Application Ser. No. 60/614,998 filed on Oct. 1, 2004, which is incorporated herein in its entirety.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates generally to a gaming system, and more specifically to a gaming system having a plurality of adjacently arranged independently operable gaming machines and a mechanical moveable gaming machine indicator operable to individually indicate the gaming machines.

BACKGROUND OF THE INVENTION

In general, gaming provides an escape from the everyday rigors of life. Gaming machines, such as slot machines and video poker machines, provide fun and excitement for the player. Bright lights and exciting sounds are often used to set a gaming machine apart from other gaming machines. Slot machines have evolved considerably since their inception. Originally, slot machines displayed purely mechanical reels. While these machines gained enormous popularity, the mechanical nature of the reels limited the number of displayed symbols and the number of different winning symbol combinations.

Computer and video technology facilitated the expansion of the possibilities for gaming machines. There are now slot-based, card-based, and other types of video gaming machines. Video gaming machines use computers to generate symbol combinations from an expanded number of different symbols. For example, video reel strips can include a virtually unlimited number of symbols, which enables a wide variety of different symbol combinations including combinations that appear very infrequently and yield high payouts. Video monitors may also provide bonus or secondary games. Bonus games in gaming machines have become much more prevalent and elaborate in recent years. For example, players play the base game until becoming eligible for a bonus game. The base game temporarily pauses, while the player plays the bonus game. When the player completes the bonus game, the gaming machine returns the player to the base game.

It should be appreciated that there is increased player attraction and excitement inherent in a base game—bonus game combination. For example, U.S. Pat. No. 6,656,048 discloses a method for providing bonus payoffs during a bonus mode time period. The method provides the bonus to a portion of interconnected, linked gaming machines. The bonus includes providing a bonus multiplier for any winning combinations obtained in the linked gaming machines. The bonus mode time period ends when a bonus pool reaches a predetermined low value.

However, there is a need for more elaborate gaming and bonus systems for continued player interest and excitement. One way the industry has met this need is with the advent of gaming systems. Gaming systems provide a way to interact with and compete against fellow players in an enjoyable and non-intrusive fashion. There is thus a need for new and improved gaming systems.

SUMMARY OF THE INVENTION

The present invention provides a gaming system having a plurality of adjacently arranged independently operable gaming machines and a mechanical moveable gaming machine indicator mounted or positioned near the gaming machines. The plurality of gaming machines or gaming devices are in communication with or linked to a central server or controller and each gaming machine in the system has the displays, input, controls, and other features of a conventional gaming machine. The controller is operable to select one, a plurality of or each of the actively played gaming machines in the gaming system and cause the gaming machine indicator to indicate the selected gaming machine. The indicated gaming machine may provide one or more awards, secondary games, or other suitable outcomes to any player actively playing the indicated gaming machine. Accordingly, the present invention provides a gaming machine system wherein at least one gaming machine indicator is operable to mechanically indicate one or more selected gaming machines in the gaming system.

In one embodiment, the gaming machine indicator includes a body or frame mounted or positioned adjacent to the plurality of gaming machines in the system. The body is movably connected to a motion producing device (via one or more support members) which is in communication with the controller. The motion producing device, such as an actuator, is operable to move the indicator relative to the plurality of gaming machines to indicate one, a plurality of or each of the gaming machines in the system. It should be appreciated that in different embodiments, the body of the gaming machine indicator may move, one or more movable members movably connected to the body of the gaming machine indicator may move, or the body of the gaming machine indicator and the movable members connected to the body of the gaming machine indicator may move in any suitable combination.

In one alternative embodiment, the body of the gaming machine indicator supports at least one illuminator that is operable to emit or reflect lighting effects onto the area of the gaming system and/or onto one or more individual gaming machines. In another alternative embodiment, the body of the gaming machine indicator supports at least one display device that is operable to display any outcome or other suitable information to one or more players of the gaming machines of the system.

In one embodiment, the gaming machines are substantially arranged in a circle around the gaming machine indicator. In this embodiment, the gaming machine indicator is mounted or positioned at or near the center of the gaming machine arrangement. The gaming machine indicator is caused to rotate above the gaming machines and stop rotating to indicate one or more of the gaming machines. In another embodiment, the gaming machines are arranged in a linear fashion with the gaming machine indicator mounted or positioned above the gaming machines. In this embodiment, the gaming machine indicator is caused to oscillate back and forth substantially parallel to a line formed by the gaming machines and stop oscillating to indicate one of the gaming machines. It should be appreciated that the gaming machines may be arranged in any suitable configuration and the mechanical moveable gaming machine indicator may be mounted using any suitable mechanism and positioned in any suitable location in relation to the gaming machines.

In one embodiment, the central controller is operable to monitor the gaming machines in the gaming system and cause the gaming machine indicator to move or rotate (via the motion producing device) to indicate one or more of the gaming machines. In one embodiment, the controller randomly selects one of the actively played gaming machines in the gaming system and causes the gaming machine indicator to indicate the selected gaming machine. In this embodiment, any award provided to the player of the selected gaming machine may be in addition to or as a substitute for any award determined based on game play. For example, if players are actively playing at five gaming machines in the gaming system, the controller randomly selects one of the five gaming machines, causes the gaming machine indicator to move to indicate the selected gaming machine and communicates to the indicated gaming machine to provide, independent of any game play at the indicated gaming machine, at least one supplemental award.

In another embodiment, upon a triggering event or qualifying condition occurring at one of the actively played gaming machines in the gaming system, the controller selects that gaming machine and causes the gaming machine indicator to indicate the selected gaming machine. In one embodiment, the controller utilizes the gaming machine indicator to indicate to the player of the selected gaming machine that a triggering event or qualifying condition has occurred. In one embodiment, an indication of a gaming machine by the gaming machine indicator functions to inform the player (as well as players at other gaming machines in the system and passerbys) that the player has advanced to a secondary game or is provided a suitable outcome. For example, if players are actively playing at five gaming machines in the gaming system and during play of one of the gaming machines a designated symbol or combination of symbols are generated, the controller causes the gaming machine indicator to move to indicate the gaming machine with the generated designated symbol or symbol combination. In this example, the controller utilizes the gaming machine indicator to indicate to the player's of the gaming machines in the gaming system that, based on one or more elements of game play, a triggering event has occurred at one of the gaming machines in the system. In another embodiment, the central controller utilizes the gaming machine indicator to function in at least one and preferably a plurality of aspects of game play.

In another embodiment, prior to causing the gaming machine indicator to indicate one of the gaming machines in the system, the controller requires a designated number of gaming machines to be actively played. In this embodiment, if less than the designated number of gaming machines are actively played, the controller may utilize the gaming machine indicator as part of an attract mode.

The present invention provides a gaming system including a plurality adjacently arranged, independently operable gaming machines and a mechanical moveable gaming machine indicator device. Incorporating a gaming machine indicator into a gaming system provides increased excitement for players as well as attracts other players to the gaming system. The gaming machine indicator causes players to perceive that the gaming system offers additional ways to win.

Additional features and advantages of the present invention are described in, and will be apparent from, the following Detailed Description of the Invention and the Figures.

DETAILED DESCRIPTION OF THE INVENTION

Figure 1A:
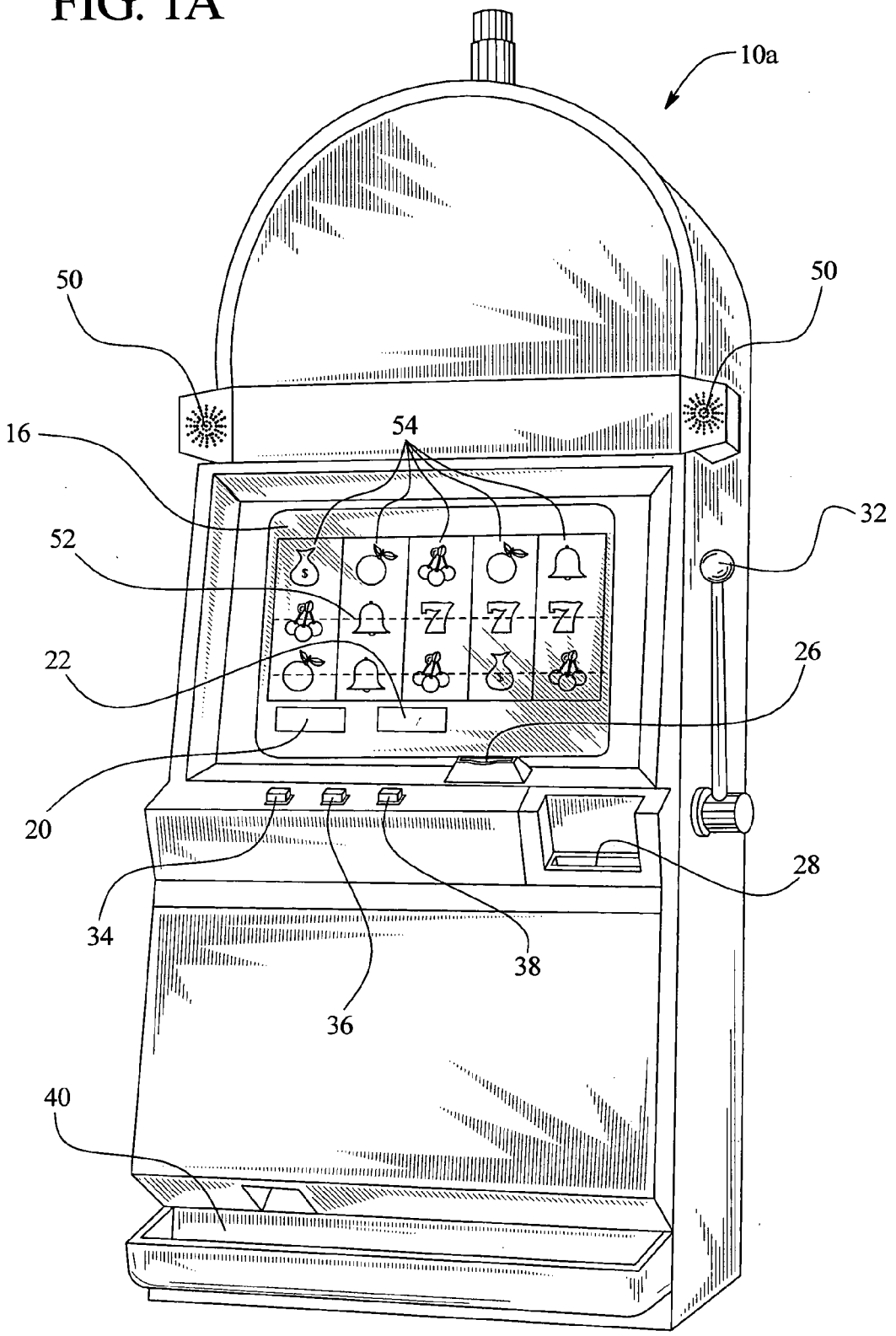
FIGS. 1A and 1B are perspective views of alternative embodiments of the gaming machines of the present invention.
Figure 1B:
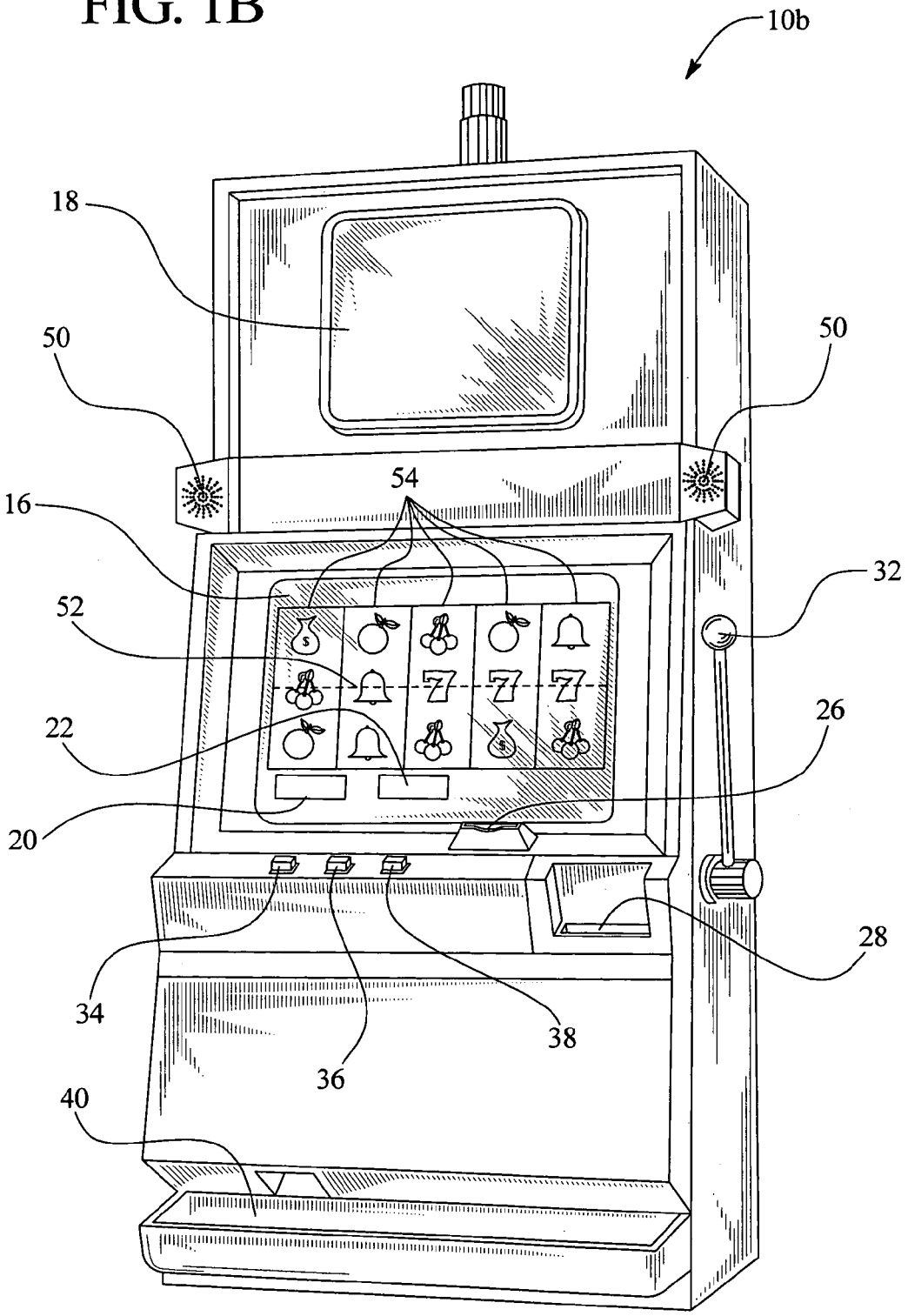

Referring now to the drawings, two alternative embodiments of the gaming devices or gaming machines of the gaming system of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, each gaming device in the system has a support structure, housing or cabinet which provides support for a plurality of displays, inputs, controls and other features of a conventional gaming machine. It is configured so that a player can operate it while standing or sitting. Each gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
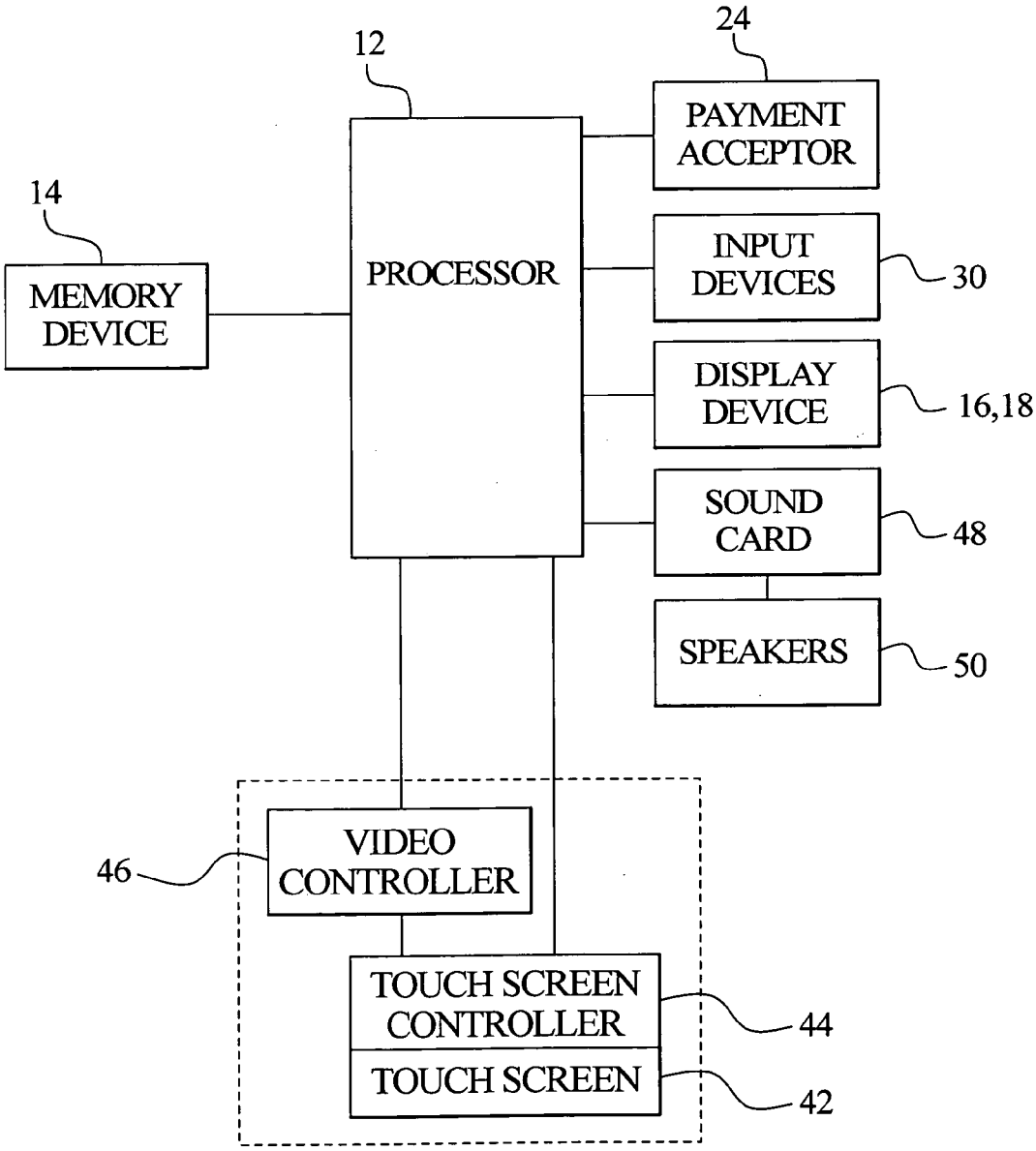
FIG. 2A is a schematic block diagram of the electronic configuration of one embodiment of one of the gaming machines of the present invention.

In one embodiment, as illustrated in FIG. 2A, one, more and preferably each of the gaming device in the system includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform.

Figure 2B:
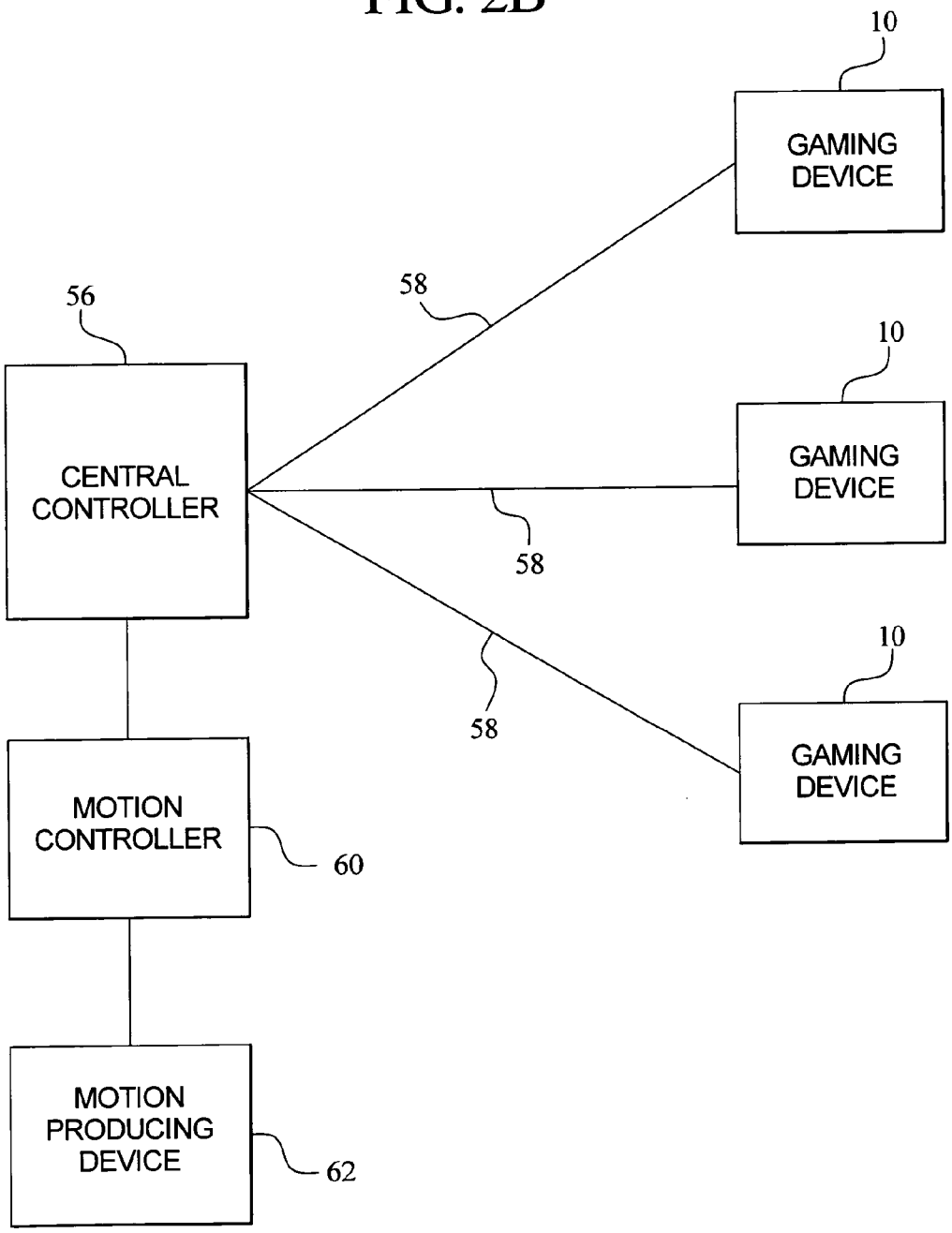
FIG. 2B is a schematic block diagram of the communication scheme of the gaming machines and the central controller of the gaming system of the present invention.

In another embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller. In one alternative embodiment, each gaming machine may include a direct communication link with the other gaming machines and/or the actuator. In another embodiment, one of the linked gaming machines functions as the central server or controller.

In one embodiment, in addition to communicating with each of the gaming machines in the system, the central controller is in communication with one or more motion controllers 60. The central controller is operable to control the output of the motion controllers which are operable to control one or more motion producing devices 62. The motion producing devices can be any combination of motors, servo motors, AC/DC motors, actuators, or any other type of electrical, electromechanical, mechanical, magnetic, electromagnetic, hydraulic, spring-loaded, or other suitable device that outputs a rotating or moving member. The motion controllers typically include printed circuit boards or stand alone enclosures that receive high level commands from the processor. The motion controller converts the high level commands, for example, into a number of step pulses, which in turn are converted into motor currents. The stepper motor or other type of motion producing device receives the currents, wherein the currents cause, for example, a rotor to turn within a stator a precise and desired amount. In one embodiment, the central controller is in communication with one or more motion controllers which are operable to control one or more motion producing devices movably connected to a gaming machine indicator. As described more below, in this embodiment, the controller communicates with the motion producing device (via the motion controller) to cause the gaming machine indicator to constantly or periodically move relative to the plurality of gaming machines and stop moving to indicate one or more of the gaming machines in the gaming system.

It should be appreciated that the controllers and motion producing devices produce a motion control scheme that may include complex movements of multiple parts. That scheme is programmed into the memory device and carried out by the processor at the appropriate time in the sequence of the game, be it a base, bonus, bonus triggering or progressive sequence of gaming device. Moreover, multiple programs can be implemented in the memory device, wherein the processor runs the appropriate program at the appropriate time, and wherein the moving display mechanism described below can perform or move differently, e.g., faster, slower or in different rotational directions at different times or points in the game. The motion control programs, in one embodiment, interface with one or more random generation devices, typically software based items, to produce randomly displayed outcomes on the displays of the present invention.

In one embodiment, a plurality of the gaming devices and the controller of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of each of the gaming devices and accumulation of credits may be accomplished with only a connection to the central server or controller (the internevintranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In one embodiment, as discussed in more detail below, one, more and preferably each of the gaming devices in the system randomly generate awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, one, more and preferably each of the gaming devices in the system employ a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, one, more and preferably each of the gaming devices in the system include one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables play of at least a portion of the primary or secondary game at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED), or any other suitable electronic device or display mechanism. In one embodiment, as described in more detail below, the display device includes a touch-screen with an associated touch-screen controller. The display devices may be of any suitable configuration, such as a square, rectangle, or elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one and preferably a plurality of game or other suitable images, symbols, or indicia.

As illustrated in FIG. 2A, in one embodiment, one, more and preferably each of the gaming devices in the system include at least one payment acceptor 24 in communication with the processor. As seen in FIGS. 1A and 1B, the payment acceptor may include a coin slot 26 and a payment, note, or bill acceptor 28, where the player inserts money, coins, or tokens. The player can place coins in the coin slot or paper money, ticket, or voucher into the payment, note, or bill acceptor. In other embodiments, devices such as readers or validators for credit cards, debit cards, or credit slips may accept payment. In one embodiment, a player may insert an identification card into a card reader of the gaming device. In one embodiment, the identification card is a smart card having a programmed microchip or a magnetic strip coded with a player's identification, credit totals, and other relevant information. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment one, more and preferably each of the gaming devices in the system include at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as video sources, expansion buses, game or other displays, an SCSI port, or a key pad.

In one embodiment, as seen in FIG. 2A, one or more and preferably each of the gaming devices in the system include a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, one, more and preferably each of the gaming devices in the system include a player sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital, or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol, or indicia.

Each gaming device in the system can incorporate any suitable wagering primary or base game. The gaming machine or device of the present invention may include some or all of the features of conventional gaming machines or devices. The primary or base game may comprise any suitable reel-type game, card game, number game, or other game of chance susceptible to representation in an electronic or electromechanical form which produces a random outcome based on probability data upon activation from a wager. That is, different primary wagering games, such as video poker games, video blackjack games, video Keno, video bingo, or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled, or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, one or more of the display devices, as described above, display the plurality of simulated video reels 54. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, one, more and preferably each of the gaming devices in the system may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play, or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game could be accomplished through a simple "buy in" by the player if, for example, the player has been unsuccessful at qualifying through other specified activities.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the game played at that gaming device. In one embodiment, the bingo or keno game is displayed to the player. In another embodiment, the bingo or keno game is not displayed to the player, but the results of the bingo or keno game determine the predetermined game outcome value for the interactive game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on an intermittent award in addition to any award provided for winning the bingo game as described above. In this embodiment, if one or more elements are marked in supplemental patterns within a designated number of drawn elements, an intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided an intermittent award regardless of if the enrolled gaming device's provided bingo card wins or does not win the bingo game as described above.

In another embodiment, one or more of the gaming devices of the present invention are in communication with a central server or controller for monitoring purposes. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions. In one embodiment, as described below, the controller monitors game play at the gaming machines in the system and when appropriate, causes the motion producing device to move the gaming machine indicator to indicate one or more of the gaming machines in the system.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment wherein the gaming system maintains one or more progressive awards, each progressive award is associated with a range of values, and each progressive award will be provided to a player at an indicated gaming device when the progressive award increments to a progressive award hit value within the range of values associated with that progressive award. In different embodiments, the progressive award hit value at which the progressive award is provided to one of the players is predetermined, randomly determined, determined based on the wagers placed in the gaming system, determined based on the status of one or more players (such as determined through a player tracking system), determined based on time, or determined based on any other suitable method. In one embodiment, a plurality of the progressive awards are associated with different value ranges. In another embodiment, each of the progressive awards is associated with a different value range. In another embodiment, a plurality of the progressive awards are associated with the same value range.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In another embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a "chip" to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

Figure 3A:
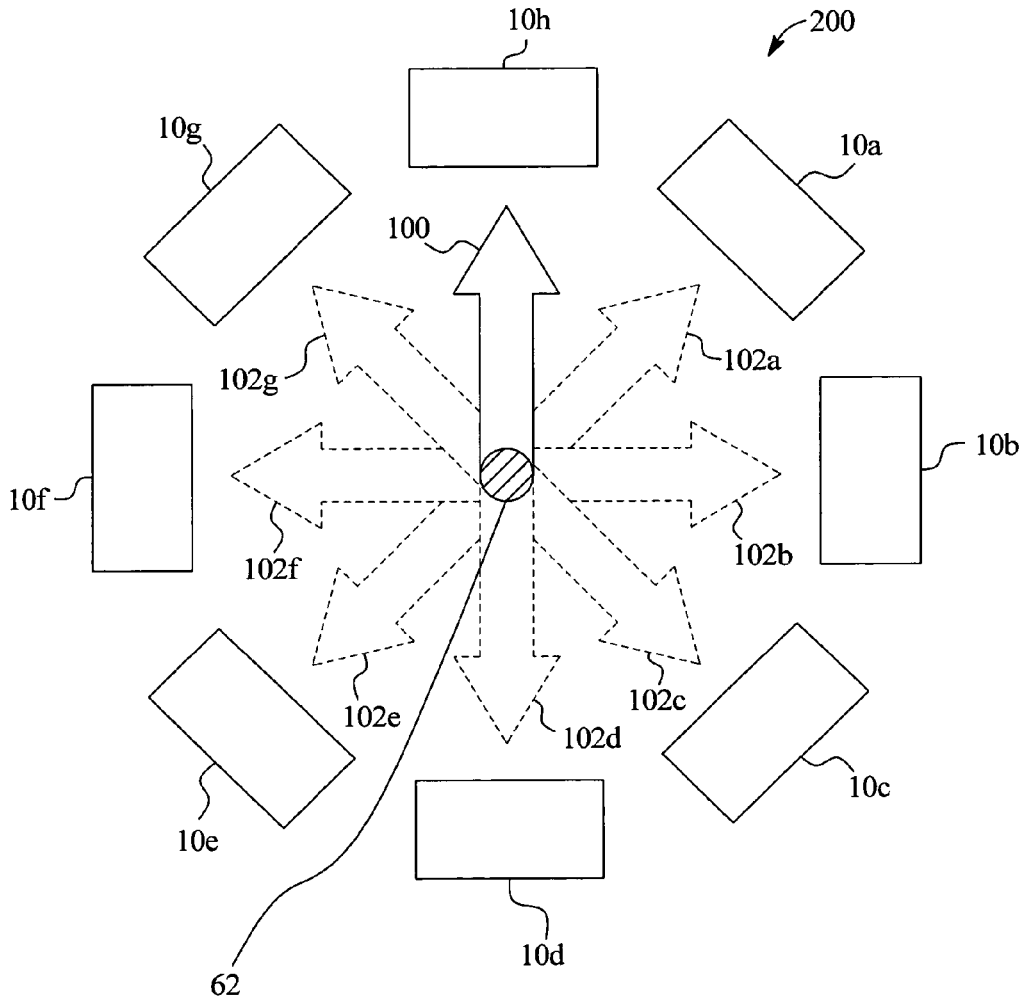
FIG. 3A is a top view of the gaming system of the present invention illustrating a plurality of gaming machines in a circular configuration wherein the mechanical moveable gaming machine indicator is substantially centered relative to the plurality of gaming machines.
Figure 3B:
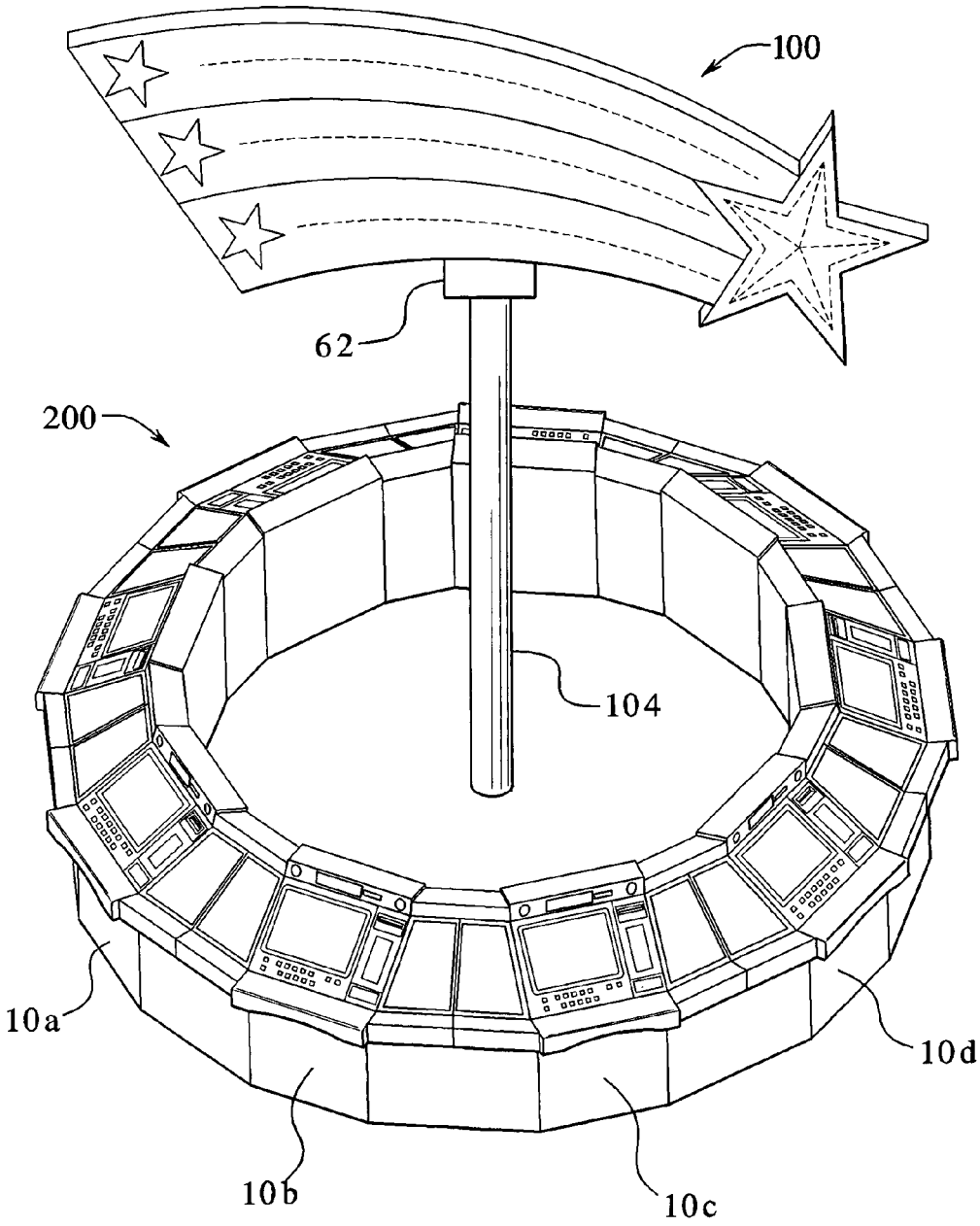
FIG. 3B is a side perspective view of the gaming system of FIG. 1A wherein the mechanical moveable gaming machine indicator is in one of its plurality of rotational positions.

Referring now to FIGS. 3A and 3B, the gaming system 200 of one embodiment of the present invention includes a plurality of gaming machines or gaming devices. In this embodiment, the gaming system includes eight gaming machines 10*a*, 10*b*, 10*c*, 10*d*, 10*e*, 10*f*, 10*g*, and 10*h* arranged adjacently to each other to substantially form a circle. It should be appreciated that any suitable number of gaming machines may be employed in accordance with the present invention. It should also be appreciated that, in one embodiment, the arrangement of the gaming machines may include any suitable closed geometry, such as a circle, oval, indented oval, square, rectangle, or any other suitable configuration where there is a continuous and closed line of gaming machines.

At least one mechanical moveable gaming machine indicator 100 is positioned or mounted at or near the center of the circle. In an alternative embodiment, the gaming system includes a plurality of gaming machine indicators. In one embodiment, each gaming machine indicator is operable to indicate a single gaming machine. In another embodiment, each gaming machine indicator is operable to indicate, either sequentially or simultaneously, a plurality of or each of the gaming machines. As described above, the gaming machine indicator is movably connected to at least one motion producing device, such as an actuator, which is in communication with the central controller. The motion producing device is operable to cause the gaming machine indicator to constantly or periodically rotate or move relative to the plurality of gaming machines of the system and stop moving to indicate at least one of the gaming machines in the system.

As illustrated in FIG. 3B, in one embodiment the gaming machine indicator is mounted to a fixture or support 104 which supports the gaming machine indicator above the plurality of gaming machines. In one embodiment, the gaming machine indicator is mounted or positioned using any suitable mechanism in association with the gaming machines. For example, the gaming machine indicator may mount to a fixture extending up from the floor, a fixture extending down from the ceiling, a fixture extending from one or more of the gaming machines, directly to one or more of the gaming machines, or by any other suitable mechanism.

FIG. 3A illustrates that the gaming machine indicator may be rotated or moved to each of a plurality of different stop or rotational positions (illustrated in phantom). In this example, each stop position corresponds to a different one of the gaming machines such that stop positions 102*a*, 102*b*, 102*c*, 102*d*, 102*e*, 102*f*, 102*g*, and 102*h* (not shown) correspond with gaming machines 10*a*, 10*b*, 10*c*, 10*d*, 10*e*, 10*f*, 10*g*, and 10*h*, respectively. In different embodiments, the gaming machine indicator may be caused to stop to indicate a particular gaming machine, more than one gaming machine or between a plurality of gaming machines. In one embodiment, if the gaming machine indicator is not moving to or stopped at one of the plurality of stop positions, the gaming machine indicator rests at a home or resting position. It should be appreciated that any suitable number and/or configuration of stop positions may be employed in accordance with the present invention.

In one embodiment, the number of stop positions at which the gaming machine indicator may stop is dependent on the number of actively played gaming machines. In one embodiment, for the gaming machine indicator to stop at a stop position associated with a particular gaming machine, that gaming machine must be actively played by a player (i.e., the player maintains a designated minimum amount of game play). In this embodiment, each gaming machine is designated as either active status or inactive status and such designation determines whether or not the gaming machine indicator may stop at a position indicating that gaming machine.

In one embodiment, a gaming machine designated as enrolled or inactive status means that the gaming machine is one of the linked gaming machines in the system, but is not being actively played by a player during a bonus event qualification period. A gaming machine may be classified as enrolled status for several reasons. For example, no player may be playing the gaming machine. In another example, a player could be playing the gaming machine (i.e., by having credits on the gaming machine), but be playing too slowly or be interrupted during play. In this case, the player could have credits on the credit meter of the gaming machine, but the player has not made a wager on a primary game or otherwise qualified for a bonus event during a bonus event qualification period.

In one embodiment, the active status means that the gaming machine is being actively played by a player during a bonus event qualification period. In one embodiment, actively playing during a bonus event qualification period means that the player is playing the primary game of the gaming machine (i.e., placing wagers on plays of the primary game) at least at a predefined minimum rate during a predefined time period. For example, the gaming machine may be in active status when a player has made at least one play of the primary game in a fifteen second period prior to the triggering of the bonus event. In this example, the bonus event qualification period is that fifteen second period prior to the triggering of the bonus event.

In another embodiment, each gaming machine's designated status is alternatively or additionally based on the amount wagered on the plays of the primary game during a bonus event qualification period. In a further alternative embodiment, each gaming machine's designated status is based on a designated minimum number of plays of the primary game or number of wagers on the primary game in a designated time period. The determination of the gaming machine's designated status may take into account other factors such as interruptions or displays in play of the primary game such as caused by the triggering of other bonuses or the operation of other secondary games of the gaming machines. In another embodiment, a gaming machine is designated in active status if an additional wager, such as a side-bet or side-wager, is made by a player at a gaming machine of the gaming system for one player of a game, a plurality of plays of a game or all plays of a game in a designed period of time, such as a designed time period. It should be appreciated that each gaming machine's designated status may be based on any one or more suitable parameters or criteria as determined by the implementer or operator of the gaming system.

Additionally, it should be appreciated that the gaming system disclosed herein contemplates other or additional methods for determining the designated status of each gaming machine. For instance, the player may be enabled to make a side wager or additional wager to be designated in active status for a subsequent time period, such as one minute. In another alternative embodiment, a minimum wager level is required for a gaming machine to be designated in active status. In one embodiment, this minimum wager level is the maximum wager level for the primary game in the gaming machine. Another method for determining if the gaming machine is active is whether or not the player has wagered a minimum level of monetary units since the occurrence of the last bonus event.

It should also be appreciated that one or more additional statuses may be employed. For instance, a gaming machine will be in an active status if an individual player playing the gaming machine is a premier player. This could be determined at least in part based on the status of that player determined via a player tracking card or other player identification device used by that player in the gaming machine. It should be further appreciated that when a gaming machine is designated in an active status, the gaming system may automatically treat the gaming machine as an active gaming machine for purposes of the other determinations including bonus event eligibility by the gaming system.

In another embodiment, the number of stop positions at which the gaming machine indicator may stop is independent of the number of actively played gaming machines wherein the gaming machine indicator may stop to indicate a gaming machine that is not actively played. In different embodiments, the number of stop positions which the gaming machine indicator may stop is predetermined, randomly determined, determined based on one or more player's wagers in one or more primary games, determined from the occurrence of one or more symbols in one or more actively played primary games, or determined based on any other suitable method.

Figure 3C:
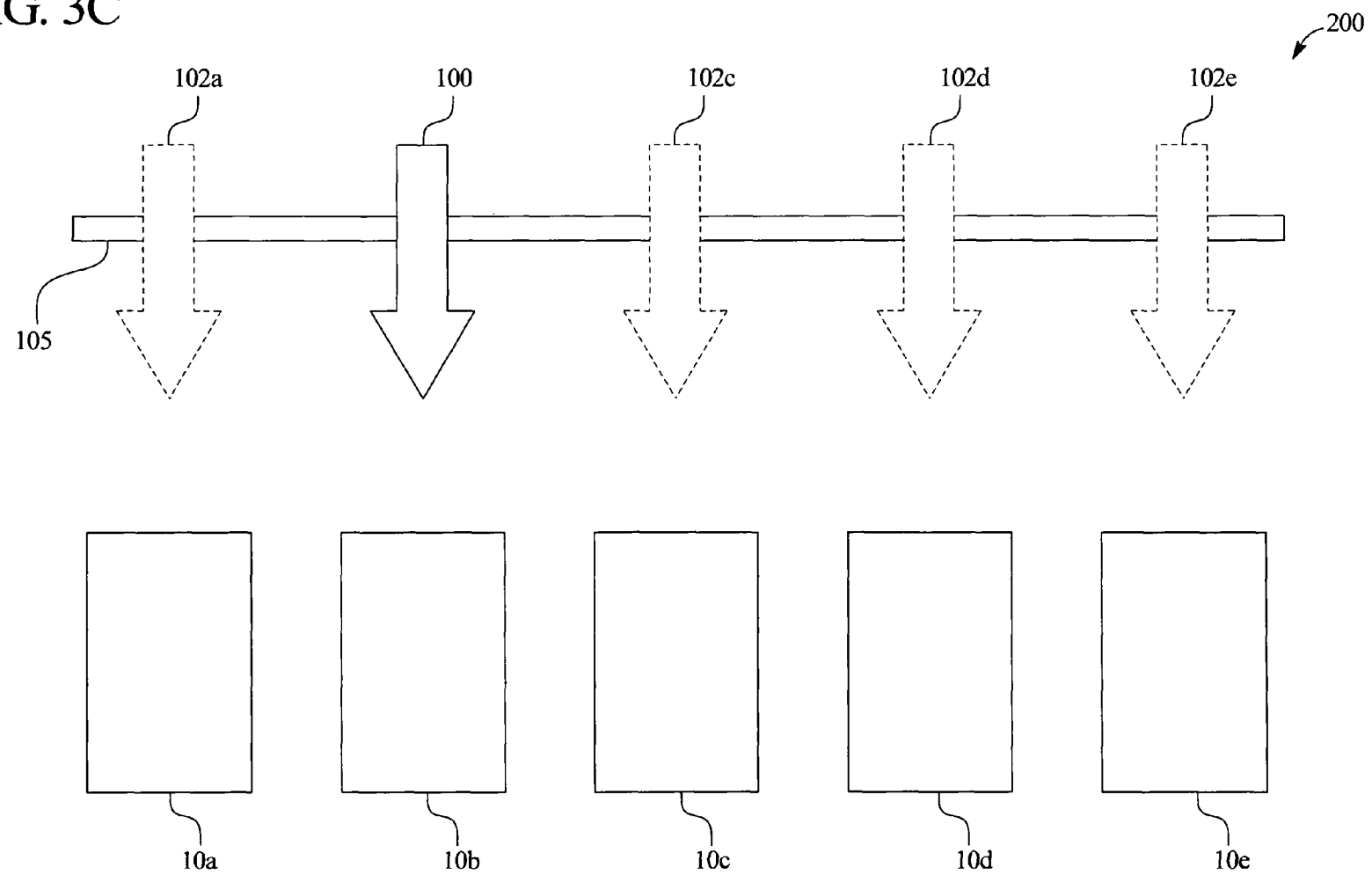
FIG. 3C is a side view of the gaming system of the present invention illustrating a plurality of gaming machines in a linear configuration wherein the mechanical moveable gaming machine indicator is positioned above the plurality of gaming machines.

As illustrated in FIG. 3C, in an alternative embodiment, the gaming system includes a plurality of gaming machines arranged in a linear fashion to collectively form a path. In this embodiment, as described below, the gaming machine indicator is mounted to a fixture or support which supports the gaming machine indicator above the adjacently arranged gaming machines and enables the gaming machine indicator to oscillate substantially parallel to the line formed by the gaming machines to indicate one or more of the gaming machines in the system. As described above regarding the circular embodiment of FIGS. 3A and 3B, this embodiment includes a plurality of stop positions at which the gaming machine indicator may stop to indicate one or more actively played gaming machines. It should be appreciated that, in one embodiment, the arrangement of the gaming machines may include any suitable open geometry, such as a straight line, a smoothly curved line, a pattern which forms a letter, such as an H pattern, a C pattern, or a T pattern, a jagged line, or any other suitable line such that the two ends do not meet.

Figure 4:
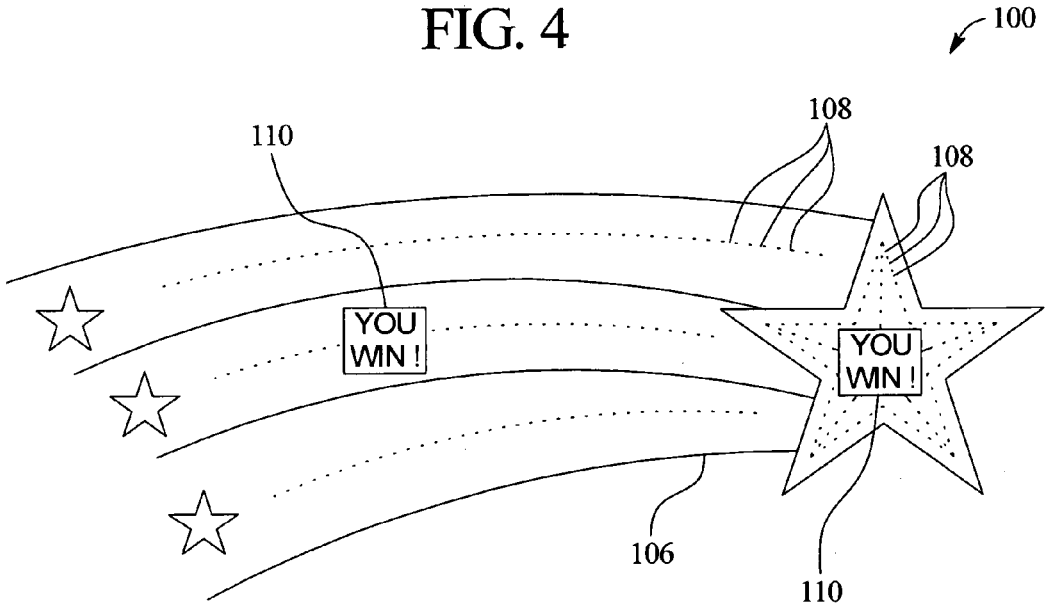
FIG. 4 is a side view illustrating one embodiment of the mechanical moveable gaming machine indicator of the present invention.

As illustrated in FIG. 4, in one embodiment, the gaming machine indicator includes a body or frame 106. The body is made of any suitable material and is suitably shaped and sized to freely move to indicate one or more of the gaming machines in the system. In one embodiment, the body supports at least one and preferably a plurality of illuminators 108. Each illuminator is in communication with the central controller and operable to emit or reflect light from the gaming machine indicator. The illuminators may utilize one or more different forms of lighting effects, such as incandescent, halogen, fluorescent, neon, strobe, laser, fiber-optic, spot, chasing rope, spotlight, light emitting diodes (LED), or any other suitable lighting effect. It should be appreciated that any suitable type of reflective device, such as a rotating, mirrored device may also be utilized as an illuminator of the gaming machine indicator.

In one embodiment, the illuminators are operable to illuminate at least one gaming machine, such as the gaming machine indicated by the gaming machine indicator. In another embodiment, the illuminators are operable to illuminate a plurality of or each of the gaming machines in the gaming system. In another embodiment, the illuminators are operable to illuminate at least one player of at least one gaming machine in the gaming system. In one embodiment, the lighting effects generated by the illuminator is dependent on game play of one or more of the actively played gaming machines in the system. In another embodiment, the lighting effects generated by the illuminator is independent of game play of the gaming machines in the system.

In one embodiment, the amount of illumination activity generated by the illuminators is constant. In another embodiment, the amount of illumination activity generated by the illuminators varies based on the activity level of play of the gaming machines in the gaming system. For example, when the activity level of play is low, the illuminators may generate more lighting effects to attract more players to the gaming machines of the gaming system. In another example, the illuminators may generate a high level of lighting effects to correspond with the selection or imminent selection of one of the gaming machines in the system by the gaming machine indicator. It should be appreciated that differing lighting effects may occur through any combination of activating, deactivating, and/or varying the intensity of the illuminators.

As illustrated in FIG. 4, in one embodiment, the body or frame supports at least one a preferably a plurality of display devices 110 in communication with the central controller. The display devices may include, without limitation, a cathode ray tube (CRT) monitor or television display, a liquid crystal display (LCD), a light emitting diode display (LED), a display based on a plurality of organic light-emitting diodes (OLEDs), a plasma display, or any other suitable electronic device or display mechanism. The display devices of the gaming machine indicator are operable to display any data, message, outcome, or other suitable information to one, more or each of the players of the gaming machines of the gaming system.

In another embodiment (not shown), the body or frame supports one or more moving parts or members, such as arms or pointers. In this embodiment, each moving member is controlled by the controller and operable to indicate, either simultaneously, sequentially, or in an overlapping fashion, one or more of the gaming machines. In one embodiment, one or more articulable moving members each include one or more movable joints. In this embodiment, the gaming device includes at least one and preferably a plurality of motion producing devices which are adapted to independently move different sections of the moving member in different directions. In another embodiment (not shown), the body or frame supports one or more sound producing devices which are controlled by the central controller. In this embodiment, the sound producing device is operable to generate sounds, such as playing music for the primary and/or secondary game or for other modes of the gaming device, such as an attract mode.

In one embodiment, the gaming machine indicator is utilized in an attract mode. In this embodiment, during idle periods, the gaming machine indicator may display a sequence of lights, audio and/or visual attraction messages to attract potential players to one of the gaming devices in the system. The videos may also be customized for or to provide any appropriate information.

In another embodiment, upon a suitable event occurring at one or more of the gaming machines in the system, such a player initiating game play at one gaming machine, the central controller causes the motion producing device to rotate or move. In different embodiments, the gaming machine indicator constantly moves, sporadically moves, or moves in any suitable fashion. The gaming machine indicator continues moving until the central controller instructs the motion producing device to stop the gaming machine indicator.

In one embodiment, the controller randomly selects one of the actively played gaming machines in the gaming system and causes the gaming machine indicator to indicate the selected gaming machine. In this embodiment, any award provided to the player of the selected gaming machine may be in addition to or as a substitute for any award determined based on game play. It should be appreciated that in this embodiment, the indication of one of the gaming machines of the gaming system is independent of any game play of any of the gaming machines in the gaming system. That is, the central controller utilizes the gaming machine indicator to indicate to the each of the players of the gaming machines (and any passerbys) that one of the actively played gaming machines will provide a supplemental award or a supplemental opportunity to obtain an award.

In one such embodiment, the gaming system does not provide any apparent reasons for indicating one or more selected gaming machines. In this embodiment, indicating a selected gaming machine is not triggered by an event in or based specifically on any of the plays of any primary game or on any of the plays of any secondary game of the gaming machines in the system. That is, the gaming machines may simply indicate a selected gaming machine (and provide the player of that indicated gaming machine a supplemental award) without any explanation or alternatively with simple explanations.

In one embodiment, one or more of the gaming machines are indicated by the gaming machine indicator based on such factors as when a designed amount of wagers are placed at one or more of the gaming devices of the gaming system. In another embodiment, one or more of the gaming machines are indicated by the gaming machine indicator based on a predefined variable reaching a defined parameter threshold. For example, a gaming machine is indicated by the gaming machine indicator if that gaming machine is currently played by the 500,000$^{th}$ player to play a gaming machine of the gaming system (ascertained from a player tracking system). In different embodiments, the predefined parameter thresholds include a length of time, a length of time after a certain dollar amount is hit, a wager level threshold for a specific machine (which gaming device is the first to contribute $250,000), a number of gaming machines which are active, or any other parameter that would define a threshold for the progressive.

In another embodiment, one or more of the gaming machines are indicated by the gaming machine indicator based on time. In this embodiment, upon a suitable triggering event, a time is set for when one of the gaming machines in the gaming system will be indicated by the gaming machine indicator. In one embodiment, such a set time may be based on historic data. In one embodiment, a suitable algorithm is implemented to determine the player who wagered at or closest to this time with tie-breaking based on any number of factors (e.g., player tracking history, amount of or recent wagers placed).

In another embodiment, one or more of the gaming machines are indicated by the gaming machine indicator based upon gaming system operator defined player eligibility parameters stored on a player tracking system (such as via a player tracking card or other suitable manner). For example, a gaming system operator may choose to only enable gaming machines actively played by players of the highest player tracking status to be eligible to be indicated. In this embodiment, the parameters for eligibility would defined by the gaming system operator based on any desired criterion.

Another embodiment for determining which gaming machine(s) are indicated by the gaming machine indicator includes a system determination, wherein which gaming machine is selected to be indicated is due to a random selection by the server. In this embodiment, controller include a tracking module to keep track of all active gaming machines and the wagers they placed. Based on the gaming machine's active or inactive state as well as one or more wager pools associated with the gaming machine, the controller determines which of these gaming machine(s) will be indicated by the gaming machine indicator. In one embodiment, a gaming machine played by a player who consistently places a higher wager would be more likely to be indicated than a gaming machine played by a player who consistently places a minimum wager.

In another embodiment, a gaming machine is indicated by the gaming machine indicator by determining if any numbers allotted to a gaming device match a randomly selected number. In this embodiment, upon or prior to each play of each gaming machine in the gaming system, a gaming machine selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, that particular gaming machine is indicated by the gaming machine indicator.

Figure 5A:
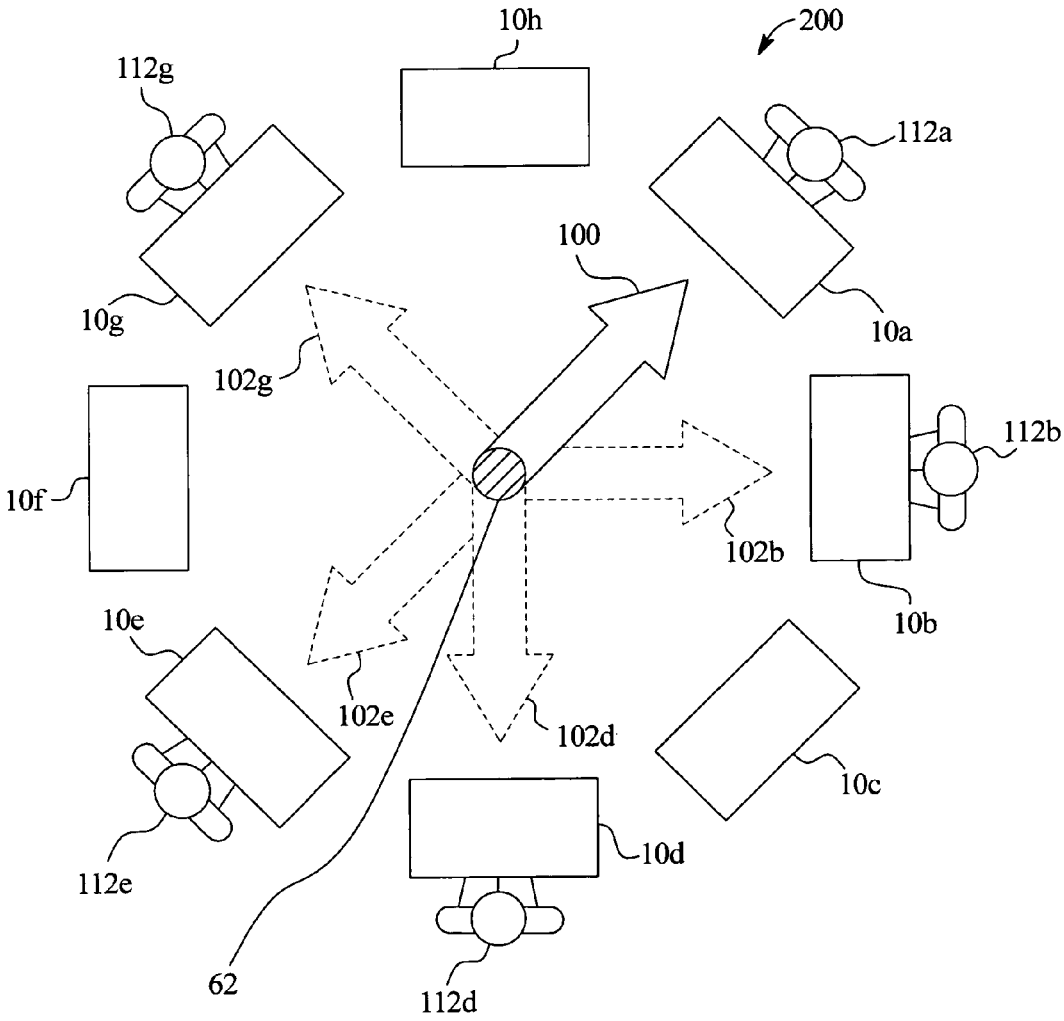
FIGS. 5A, 5B and 5C are front elevational views of one of one embodiment of the present invention illustrating the mechanical movable gaming machine indicator selecting one of the plurality of gaming machines in the gaming system.

For example, as illustrated in FIG. 5A, five of the eight gaming machines in the gaming system are actively played and thus these five gaming machines may be selected by the controller to be indicated by the gaming machine indicator and obtain one or more awards. In this example, players 112*a*, 112*b*, 112*d*, 112*e*, and 112*g* are actively playing gaming machines 10*a*, 10*b*, 10*d*, 10*e*, and 10*g*, respectively, and thus the gaming machine indicator is operable to be stopped at stop positions 102*a* (not shown), 102*b*, 102*d*, 102*e*, and 102*g*, respectively associated with the actively played gaming machines.

In one embodiment, a designated number of gaming machines must be actively played for the controller to randomly select one of the gaming machines to cause the gaming machine indicator to indicate. In one embodiment, each of the gaming machines in the system must be actively played for the controller to randomly select one of the gaming machines to be indicated. In different embodiments, the designated number of required actively played gaming machines in the system is predetermined, randomly determined, determined based on one or more player's wager in one or more primary games of the gaming system, determined from the occurrence of one or more symbols in one or more primary games of the system, or determined based on any other suitable method. In another embodiment, there is no designated number of required actively played gaming machines in the system.

Figure 5B:
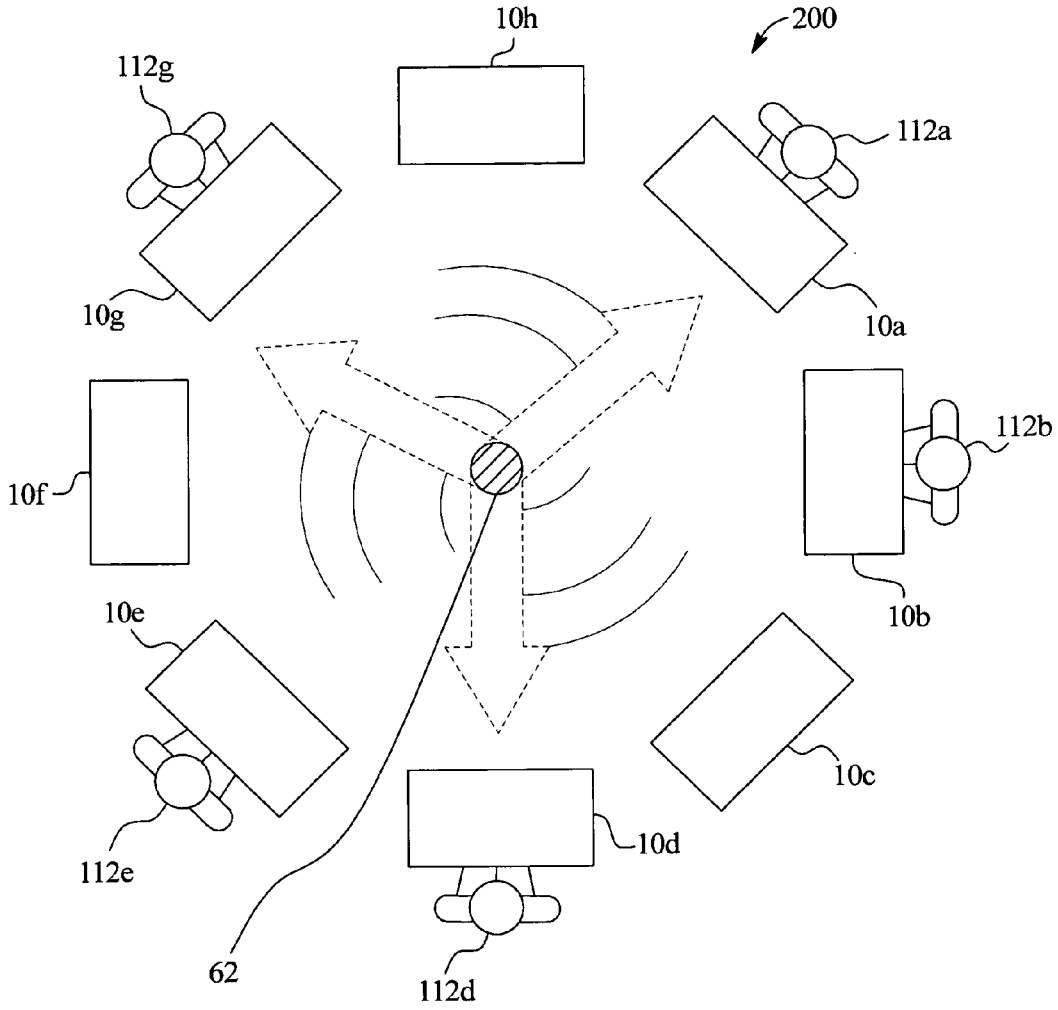

As illustrated in FIG. 5B, at a random time during operation of the gaming system, the controller determines that one of the actively played gaming machines will be selected and indicated by the gaming machine indicator. Accordingly, the controller selects one of the gaming machines and communicates instructions to the motion producing device to spin or rotate the gaming machine indicator. The gaming machine indicator may rotate smoothly or step-wise and the rotations may be constant or periodic.

Figure 5C:
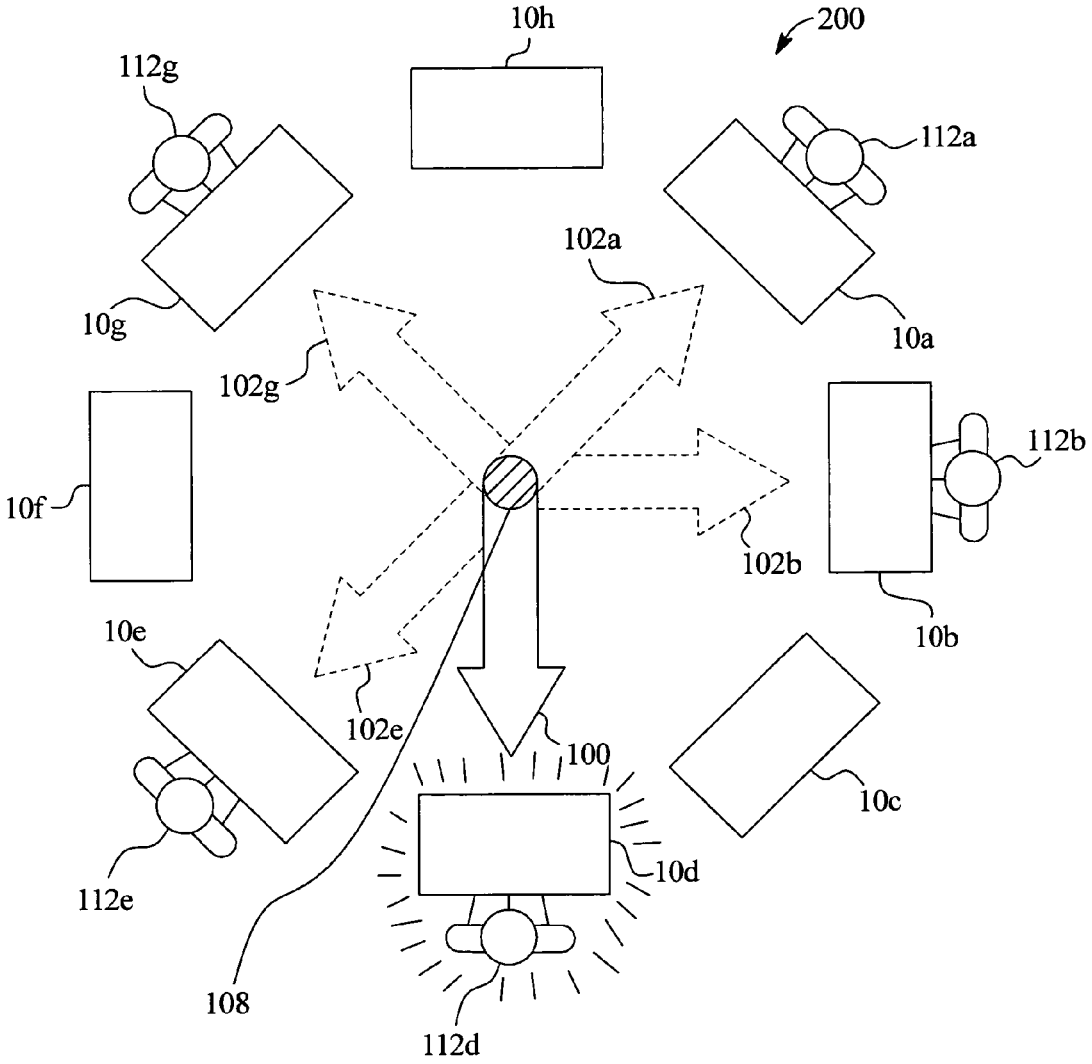

As illustrated in FIG. 5C, the controller selected gaming machine 10*d* and thus caused the motion producing device to stop the rotating gaming machine indicator to indicate gaming machine 10*d*. Accordingly, the controller instructs the indicated gaming machine to provide the player of gaming machine 10*d* one or more awards independent of any award provided to that player for any game play occurrence.

In different embodiments, the awards may be any combination of values, credits, multipliers, progressive awards, free picks, free spins, free games, game elements, or any other suitable monetary or non-monetary prize. In one embodiment, each of the awards is selected from one or more pools of awards. In another embodiment, each of the awards is selected from one or more ranges of awards. In different embodiments, the awards provided to the players of the actively played gaming machines indicated by the gaming machine indicator are predetermined, randomly determined, determined based on one or more player's wager in one or more primary games of the gaming system, determined from the occurrence of one or more symbols in one or more primary games of the system, or determined based on any other suitable method.

It should be appreciated that if the central controller selects an actively played gaming machine to be indicated by the gaming machine indicator (thus providing a supplemental award to the player of the indicated gaming machine) and the player of that gaming machine cashes out and leaves before that gaming machine is indicated, the central controller is operable to select another one of the actively played gaming machines in the system. In another embodiment, the central controller is operable to cause the motion producing device to stop the gaming machine indicator to indicate a gaming machine which is not actively played by a player. In one embodiment, the next player to initiate game play at the indicated gaming machine is provided any determined supplemental award. In another embodiment, no award is provided for the next player of the indicated gaming machine. This embodiment provides increased excitement because players and potential players become aware that they would have been provided a supplemental award if they had selected to play at the indicated gaming machine.

In another embodiment, upon a triggering event or qualifying condition occurring at one of the actively played gaming machines in the gaming system, the controller selects that gaming machine and causes the gaming machine indicator to indicate the selected gaming machine. In this embodiment, the controller may utilize the gaming machine indicator to indicate to the player of the selected gaming machine that a triggering event or qualifying condition has occurred and the player has advanced to a secondary game or has been provided any other suitable outcome.

In another embodiment, either randomly or upon the occurrence of a triggering event, the controller selects a plurality of gaming machines using any suitable selection method. In this embodiment, the controller causes the gaming machine indicator to indicate the selected plurality of gaming machines either sequentially, simultaneously, or in any other suitable order.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system having a central controller, said gaming system comprising:

a plurality of gaming machines, each gaming machine in communication with said central controller and including at least one display device;

at least one input device;

at least one processor; and at least one memory device which stores a plurality of instructions, which when executed by the at least one processor, cause the at least one processor to operate with the at least one display device and the at least one input device to:

(a) enable a player to place at least one wager on at least one play of at least one primary wagering game, and (b) for each play of the primary wagering game:

(i) randomly generate a game outcome, (ii) determine if the generated game outcome is associated with a primary wagering game award, and (iii) provide to the player any primary wagering game award determined to be associated with generated game outcome;

at least one motion producing device controlled by the central controller; and at least one mechanical gaming machine indicator connected to said motion producing device ,wherein said central controller is configured to:

(a)randomly select at least one of the gaming machines to provide a supplemental award, said random selection occurring:

(i) independent of each game outcome generated in each play of each the primary wagering games of each of the gaming machines, (ii) independent of the wagers placed on each of the plays of each of the primary wagering games of each of the gaming machines, and (iii) independent of any amount of the wagers placed on each of the plays of each of the primary wagering games of each of the gaming machines:

(b) cause the motion producing device to move the gaming machine indicator to indicate the selected gaming machine;

(c) determine if the selected gaming machine is actively played, said determination based, at least in part, on if at least a designated minimum wager has been placed on the at least one play of the primary wagering game of the selected gaming machine during a bonus event qualification period; and (d) if the selected gaming machine is actively played, thereafter cause the selected gaming machine to provide the player of said gaming machine said supplemental award, wherein said provided supplemental award is independent of each game outcome generated by the selected gaming machine.

2. The gaming system of claim 1, wherein the central controller is configured to cause the motion producing device to move the gaming machine indicator into a plurality of positions prior to selecting at least one of the gaming machines.

3. The gaming system of claim 1, wherein the central controller is configured to randomly select a plurality of the gaming machines independent of each game outcome generated in each play of each of the primary wagering games of each of the gaming machines.

4. The gaming system of claim 1, wherein the gaming machine indicator includes a plurality of articulable members and the motion producing device operable to independently move each articulable member.

5. The gaming system of claim 4, wherein each articulable member is configured to indicate a different one of the gaming machines.

6. The gaming system of claim 1, wherein the gaming machine indicator includes at least one illuminator.

7. The gaming system of claim 1, wherein the gaming machine indicator includes at least one member from the group consisting of: a display device, a sound producing device, a sound recording device, a video recording device, and a photographic device.

8. The gaming system of claim 1, wherein the gaming machines are adjacently arranged in a closed configuration.

9. The gaming system of claim 8, wherein the central controller is configured to cause the motion producing device to rotate the gaming machine indicator adjacent to the gaming machines and to stop rotating the gaming machine indicator to indicate the selected gaming machine.

10. The gaming system of claim 1, wherein the gaming machines are adjacently arranged in an open configuration.

11. The gaming system of claim 10, wherein the central controller is configured to cause the motion producing device to oscillate the gaming machine indicator adjacent to the gaming machines and to stop oscillating the gaming machine indicator to indicate the selected gaming machine.

12. A gaming system having a central controller, said gaming system comprising:

a plurality of gaming machines, each gaming machine in communication with said central controller and including:

at least one display device;

at least input device;

at least one processor; and at least one memory device which stores a plurality of instructions, which when executed by the at least one processor, cause the at least one processor to operate with the at least one display device and the at least one input device to:

(a) enable a player to place at least one wager on at least one play of at least one primary wagering game, and (b) for each of the primary wagering game:

(i) randomly generate a game outcome, (ii) determine if the generated game outcome is associated with a primary wagering game award, and (iii)provide to the player any primary wagering game award determined to be associated with the generated game outcome;

at least one motion producing device controlled by the central controller; and at least one mechanical gaming machine indicator connected to said motion producing device, wherein said central controller is configured to:

(a) randomly select at least one of the gaming machines to provide a supplemental award upon the occurrence of a triggering event in at least one of the primary wagering games played on at least one of the gaming machines, wherein said random selection is:

(i) independent of each game outcome generated in each play of each of the primary wagering games of each of the gaming machines, (ii) independent of the wagers placed on each of the plays of each of the primary wagering games of each of the gaming machines, and (iii) independent of any amount of the wagers placed on each of the plays of each of the primary wagering games of each of the gaming machines, (b) cause the motion producing device to move the gaming machine indicator to indicate the selected gaming machine, and (c) thereafter, cause the selected gaming machine to provide any player of said gaming machine said supplemental award, wherein said provided supplemental award is independent of each game outcome generated by said gaming machine.

13. The gaming system of claim 12, wherein the central controller is configured to cause the motion producing device to move the gaming machine indicator into a plurality of positions prior to selecting at least one of the gaming machines.

14. The gaming system of claim 12, wherein the primary wagering game of the selected gaming machine is the primary wagering game in which the triggering event occurs.

15. The gaming system of claim 12, wherein the primary wagering game of at least one of the gaming machines other than the selected gaming machine is the primary wagering game in which triggering event occurs.

16. A method of operating a gaming system having a central controller, said method compromising:

(a) for each of a plurality of independent gaming machines in communication with the central controller:

(i) enabling a player to place at least one wager on at least one play of at least one primary wagering game, and (ii)for each play of the primary wagering game:

(A) randomly generating a game outcome, (B) determining if the generated game outcome is associated with a primary wagering game award, and (C) providing to the player any primary wagering game award determined to be associated with generated game outcome;

(b) randomly selecting at least one of the played gaming machines to provide a supplemental award, said random selection occurring:

(i) independent of each game outcome generated in each play of each of the primary wagering games of each of the gaming machines, (ii) independent of the wagers placed on each of the plays of each of the primary wagering games of each of the gaming machines, and (iii) independent of any amount of the wagers placed on each of the plays of each of the primary wagering games of each of the gaming machines;

(c) moving at least one gaming machine indicator to indicate the selected gaming machine;

(d) determining if the selected gaming machine is actively played, said determination based, at least in part, on if at least a designated minimum wager has been placed on the at least one play of the primary wagering game of the selected gaming machine during a bonus event qualification period; and (e) if the selected gaming machine is actively played, thereafter providing the player of said gaming machine said supplemental award, wherein said provided award is independent of each game outcome generated by said gaming machine.

17. The method of claim 16, which includes moving the gaming machine indicator prior to selecting at least one of the gaming machines.

18. The method of claim 16, which includes randomly selecting a plurality of the gaming machines independent of each game outcome generated in each play of the primary wagering games of each of the gaming machines.

19. The method of claim 16, which includes illuminating the selected gaming machine.

20. The method of claim 16, which includes randomly selecting a plurality of gaming machines, moving a plurality of gaming machine indicators to simultaneously indicate each selected gaming machine.

21. The method of claim 16, which includes randomly selecting a plurality of gaming machines, moving a plurality of gaming machine indicators to sequentially indicate each selected gaming machine.

22. The method of claim 16, wherein moving the gaming machine indicator to indicate the selected gaming machine includes displaying images, displaying messages, or broadcasting sounds.

23. The method of claim 16, which is provided through a data network.

24. The method of claim 23, wherein the data network is an internet.

25. A method of operating a gaming system having a central controller, said method comprising:

(a) for each of a plurality of gaming machines in communication with the central controller:

(i) enabling a player to place at least one wager on at least one play of at least one primary wagering game, and (ii) for each play of the primary wagering game:

(A) randomly generating a game outcome, (B) determining if the generated game outcome is associated with a primary wagering game award, and (C) providing to the player any primary wagering game award determined to be associated with the generated game outcome;

(b) determining if a triggering event occurs in at least one of the primary wagering games of at least one of the gaming machines;

(c) upon the occurrence of a triggering event, randomly selecting at least one of the gaming machines to provide a supplemental award, wherein said random selection is:

(i) independent of each game outcome generated in each play of each of the primary wagering games of each of the gaming machines, (ii) independent of the wagers placed on each of the plays of each of the primary wagering games of each of the gaming machines, and p2 (iii) independent of any amount of the wagers placed on each of the plays of each of the primary wagering games of each of the gaming machines;

(d) moving at least one gaming machine indicator to indicate the selected gaming machine; and (e) thereafter, providing any player of said gaming machine said supplemental award, wherein said provided supplemental award is independent of each game outcome generated by said gaming machine.

26. The method of claim 25, wherein the primary wagering game of the selected gaming machine is the primary wagering game in which the triggering event occurs.

27. The method of claim 25, wherein the primary wagering game of at least one of the gaming machines other than the selected gaming machines is the primary wagering game in which the triggering event occurs.

28. The method of claim 25, which includes moving the gaming machine indicator prior to selecting at least one of the gaming machines.

29. The method of claim 25, which is provided through a data network.

30. The method of claim 29, wherein the data network is an internet.

* * * * *